United States Patent [19]

Barozzi et al.

[11] 4,381,156

[45] Apr. 26, 1983

[54] TAB SETTING DEVICE OF TYPEWRITER

[75] Inventors: Gian P. Barozzi; Giancarlo Horeschi, both of Tokyo, Japan

[73] Assignee: Tokyo Juki Industrial Co., Ltd., Tokyo, Japan

[21] Appl. No.: 279,032

[22] Filed: Jun. 30, 1981

[30] Foreign Application Priority Data

Jul. 11, 1980 [JP] Japan ..... 55-94938

[51] Int. Cl.[3] ..... B41J 21/04

[52] U.S. Cl. ..... 400/296.1

[58] Field of Search ..... 400/296.1, 288, 295.1, 400/295.2, 296, 297

[56] References Cited

U.S. PATENT DOCUMENTS 3,283,872 11/1966 Frechette ..... 400/296.1 X 3,583,542 6/1971 Parker ..... 400/296.1

FOREIGN PATENT DOCUMENTS 2548310 5/1977 Fed. Rep. of Germany ... 400/296.1

1521353 4/1968 France ..... 400/296.1

OTHER PUBLICATIONS

IBM Technical Disclosure Bulletin, vol. 21, No. 9, Feb. 1979, pp. 3699–3700 "Typewriter Tab Rack Rotating Device" by Lennon.

*Primary Examiner*—Paul T. Sewell

*Assistant Examiner*—Charles Pearson

*Attorney, Agent, or Firm*—Koda and Androlia

[57] ABSTRACT

The present invention relates to a tab setting device for stopping a carriage of a typewriter at a desired position. This tab setting device includes an unusual-shape hole formed in a frame of the typewriter in which a tab bracket can rock. In this unusual-shape hole, two pairs of projections for supporting the tab bracket are formed on the bottom surface, one pair of the projections serve as fulcrums for rocking of the tab bracket when a tab pin or pins are tab-set, while the other pair of the projections serve as fulcrums for rocking of the tab bracket when a tab pin or pins are cleared.

3 Claims, 4 Drawing Figures

TAB SETTING DEVICE OF TYPEWRITER

BACKGROUND OF THE INVENTION

1. Field of the Invention

This invention relates to tab setting devices of typewriters, and more particularly to a tab setting device of a typewriter, wherein a plurality of tab pins are orientedly and slidably inserted through a tab bracket, and a tab pin or pins at positions where a carriage is to be stopped, are projected into a carriage moving path, to thereby stop the carriage.

2. Description of the Prior Art

As is well known, the tab setting device of a typewriter is a device for stopping a carriage of the typewriter at a desired position or positions, and there have been proposed various constructions of the tab setting device. However, all of the conventional tab setting devices present such disadvantages that the construction is complicated and a large mounting space is required.

SUMMARY OF THE INVENTION

The present invention has been developed to obviate the above described disadvantages of the conventional tab setting device of the typewriter and has as its object the provision of a tab setting device having a simplified construction and requiring a small mounting space.

According to the present invention, in a tab setting device of a typewriter, wherein a plurality of tab pins are orientedly and slidably inserted through a tab bracket and a tab pin or pins at positions where a carriage is to be stopped are projected into a carriage moving path to stop the carriage, an unusual-shape hole in which the tab bracket can rock is formed in a typewriter frame, the tab bracket is supported by two pairs of projections formed on the bottom surface of the unusual-shape hole, and one pair of the projections serves as fulcrums for rocking of the tab bracket when a tab pin or pins are projected and the other pair serves as fulcrums for rocking of the tab bracket when the projected tab pin or pins are retracted, and hence, the present invention can offer such advantages that the construction of the tab setting device is simplified and a space required for rocking of the tab bracket is minimized.

BRIEF DESCRIPTION OF THE DRAWINGS

The abovedescribed and other objects, features and advantages of the present invention will become apparent more fully from the description of the following embodiment in conjunction with the accompanying drawings wherein.

DETAILED DESCRIPTION OF THE INVENTION

Figure 1:
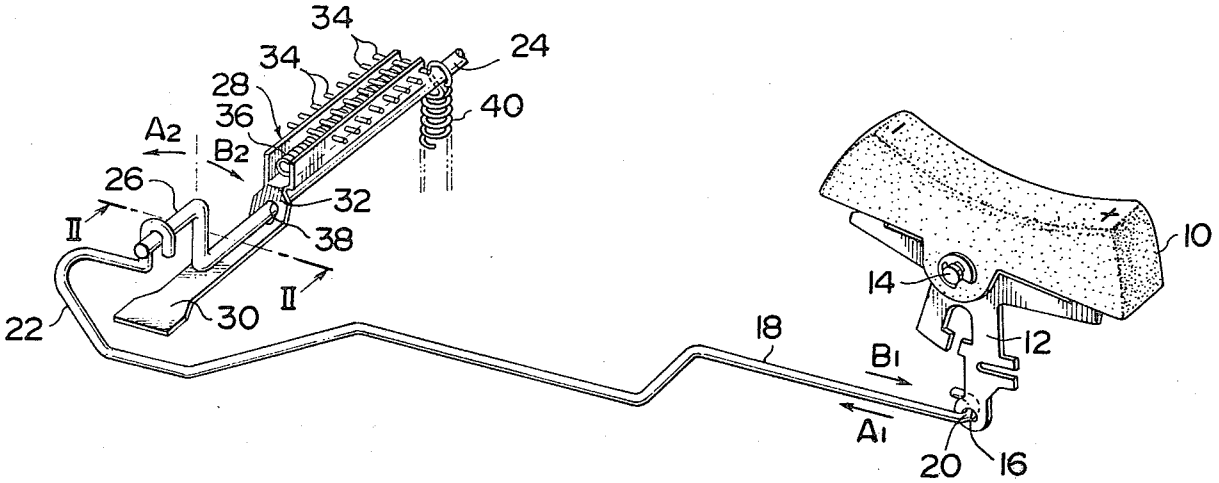
FIG. 1 is a perspective view showing construction in which a tab set clear button is connected to a tab bracket in an embodiment of the present invention.

Referring to FIG. 1, solidly secured to the undersurface of a tab set clear button 10 made of a synthetic resin material is a lever 12, which rocks about a shaft 14. If the tab set clear button 10 is pressed at the side of a plus mark printed on the top surface of the button, then a tab pin to be described hereinafter is set. While, if the tab set clear button 10 is pressed at the side of a minus mark, then the tab pin which has been set is cleared. One end of a link 18, i.e., a small bent portion 20, is engaged with a hole 16 formed at the lower end portion of the lever 12. Consequently, if the tab set clear button 10 is pressed at the side of the plus mark, then the link 18 moves in a direction indicated by an arrow $A_1$ to set a tab pin. Conversely, if the tab set clear button 10 is pressed at the side of minus mark, then the link 18 moves in a direction indicated by an arrow $B_1$ to clear the tab pin which has been set. Formed at the other end of the link 18 is a large bent portion 22, which is engaged with an end portion 26, which is bent into a crank shape, of a tab shaft 24. As shown in FIG. 1, a tab bracket 28 is constructed such that the intermediate portion thereof is bent to provide a portion being of a U-shape in cross section and the opposite end portions thereof are formed into bottom plates 30 connected to the U-shaped intermediate portion through connecting portions 32 (in FIG. 1, only one of the end portions is shown). As shown in FIG. 1, tab pins 34 are slidably inserted through the U-shaped intermediate portion of the tab bracket 28 in the transverse direction of the tab bracket. A plurality of tab pins 34 are oriented in the longitudinal direction of the tab bracket 28 at regular intervals. A spring 36 is disposed longitudinally of the tab bracket 28 in the U-shaped bent portion of the tab bracket under the tab pins 34. The bottom surfaces of the tab pins 34 contact the top surface of the spring 36, whereby a certain value of frictional resistance is rendered to the tab pin 34 when it is projected or retracted, so that the tab pin 34 can be prevented from moving accidentally. In the tab bracket 28, holes 38 are formed in joint portions between the bottom plates 30 and the connecting portions 32, the tab shaft 24 disposed downwardly of the U-shaped bent portion of the tab bracket 28 is inserted through the holes 38. The right end portion of the tab shaft 24 is bent upwardly into a crank shape over the bottom plate 30 to provide an end portion 26 engageable with the end portion 22 of the link 18. Furthermore, as shown in FIG. 1, engaged with the tab shaft 24 is one end of the spring 40, the other end of which is secured to the frame of the typewriter for urging the tab bracket 28 downwardly.

In the tab setting device of a typewriter being of the arrangement as described above, if the tab set clear button 10 is pressed at the side of the plus mark, then the link 18 moves in the direction indicated by the arrow $A_1$, whereby the tab shaft 24 engaged with the link 18 is rocked, so that the tab bracket 28 solidly secured to the tab shaft 24 can be rocked in a direction indicated by an arrow $A_2$. If the tab clear button 10 is pressed at the side of the minus mark, then the link 18 moves in the direction indicated by the arrow $B_1$, whereby the tab shaft 24 engaged with the link 18 is rocked, so that the tab bracket 28 can be rocked in a direction indicated by an arrow $B_2$ to clear the tab pin 34 which has been set.

Figure 2:
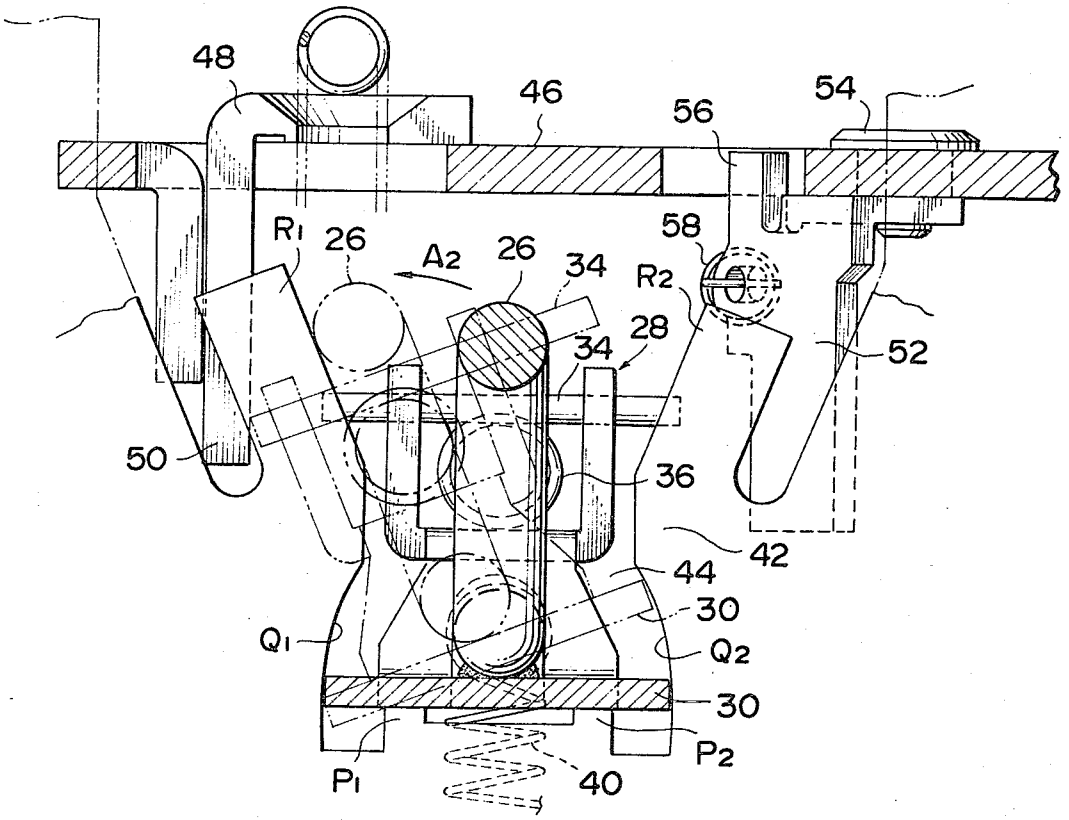
FIG. 2 is a sectional view taken along the line II—II in FIG. 1, showing the state of setting a tab in the embodiment of the present invention.

FIG. 2 further shows the tab setting device in detail in the embodiment of the present invention illustrated in FIG. 1. As shown in FIG. 2, an unusual-shape hole 44 is formed in a frame 42 of the typewriter, and the bottom plates 30 are disposed in the unusual-shape hole 44. The unusual-shape hole 44 is provided at opposite sides thereof with curved surfaces $Q_1$ and $Q_2$, as shown, and at the bottom surface thereof with pairs of projections $P_1$ and $P_2$ at predetermined intervals. Mounted on the pairs of projections $P_1$ and $P_2$ are bottom plates 30 of the aforesaid tab bracket 28, the pair of projections $P_1$ constitute fulcrums for rocking of the tab bracket 28 when the tab bracket is rocked to set the tab pin, i.e., the tab bracket is rocked in the direction indicated by the arrow $A_2$. The pair of projections $P_2$ constitute fulcrums for rocking of the tab bracket 28 when the tab bracket is rocked to clear the tab pin, i.e., the tab bracket is rocked in the direction indicated by the arrow $B_2$. Consequently, the curved surfaces $Q_1$ and $Q_2$ of the unusual-shape hole 44 is formed such that the bottom plates 30 can be rocked within the unusual-shape hole 44. In the frame 42 of the typewriter, projected members $R_1$ and $R_2$ are formed at opposing upper portions, holding therebetween the unusual-shape hole 44 and fulfill a function of a stopper for abutting against the end portion 26 of the tab shaft 24 when the tab bracket 28 is rocked in the directions indicated by the arrows $A_2$ and $B_2$.

Description will hereunder be given of the action of the embodiment of the present invention having the arrangement as decribed above. Firstly, to tab-set the carriage, not shown, the carriage is moved to a position where the carriage is to be tab-set. When the carriage is moved to a predetermined position, a tab set lever 48 secured to a carrier frame 46 is stopped at a position where is located the tab pin 34, as shown in the upper left part of FIG. 2, corresponding to a position where the carriage is to be stopped. As shown in FIG. 2, the tab set lever 48 is bent into a L-shape, and the tab pin 34 abuts against an end portion 50 of the tab set lever 48. Each of the end portions 50 has a width substantially identical with the diameter of the tab pin 34, so that it can press only one tab pin. In this condition, if the tab set clear button 10 is pressed at the side of the plus mark, then the bracket 28 is rocked about the pair of projections $P_1$ in the direction indicated by the arrow $A_2$ in FIG. 2 to a position indicated by two-dot chain lines in FIG. 2. This is a position where the end portion 26 of the tab shaft 24 abuts against the projected member $R_1$. If the tab bracket 28 is rocked to this position, then the tab pin 34 at the clearing position indicated by solid lines in FIG. 2 is urged by the end portion 50 of the tab set lever 48 to move to the right in the drawing with respect to the tab bracket 28. If the tab pin 34 disposed at a predetermined position moves to the right, then the tab pin 34 is projected into the carriage moving path, not shown, whereby the carriage is stopped at a predetermined position by the projected tab pin 34.

Figure 3:
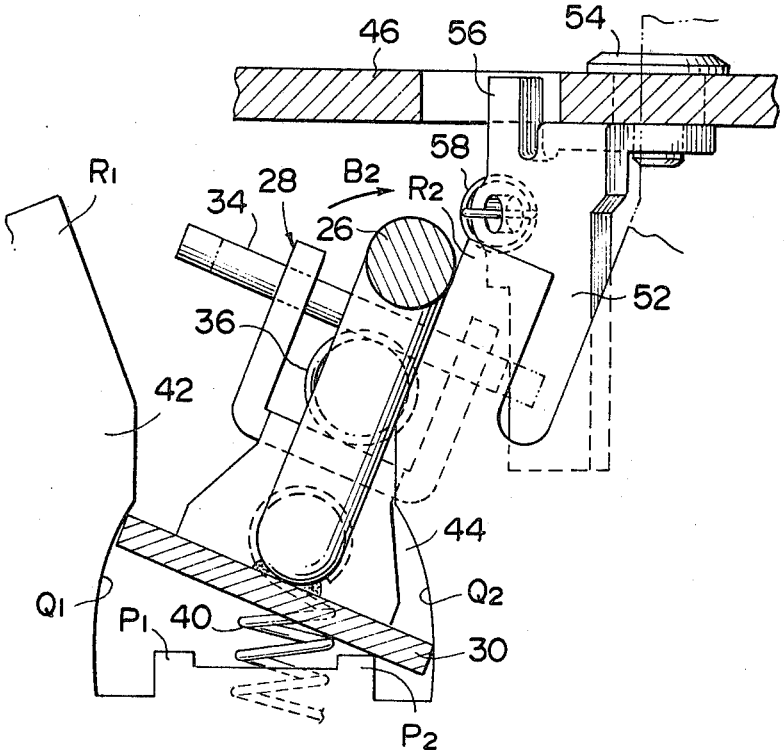
FIG. 3 is a sectional view showing the state of clearing tab in the embodiment of the present invention.

FIG. 3 shows the state of clearing a tab. Firstly, to clear the tab, the carriage is moved and then stopped by the tab pin 34 which has been tab-set. When the carriage is brought to this position, a tab clear wing 52 secured to the carrier frame 46 is placed upwardly and rightwardly of the tab bracket 28 in FIG. 3. As shown in FIG. 3, the tab clear wing 52 is pivotally supported by the carrier frame 46 through a pin 54 and urged by a spring 58 so that a projected member 56 of the tab clear wing 52 can abut against the carrier frame 46. The tab clear wing 52 is disposed in a slightly inclined position relative to the tab bracket 28, whereby the spring 58 applies a tensile force to the tab clear wing 52. In this condition, if the tab set clear button 10 is pressed at the side of the minus mark, then the tab bracket 28 rotates about the pair of projections $P_2$ in the direction indicated by the arrow $B_2$ in FIG. 3 to rock to a position indicated by solid lines in the drawing. In the position indicated by the solid lines, the end portion 26 of the tab shaft 24 abuts against the projected member $R_2$, and in this position, a predetermined pin 34 which has been tab-set is pressed by the tab clear wing 52 and moves to the left in the drawing with respect to the tab bracket 28. When the tab pin 34 moves to the left in FIG. 3 with respect to the tab bracket 28, the tab pin 34 recedes from the carriage moving path, not shown, whereby the tab pin 34 is cleared from the tab-set condition.

As shown in FIGS. 2 and 3, in the abovedescribed embodiment, the fulcrums for rocking of the tab bracket 28 are formed on the portions of the unusual-shape hole 44 as the pairs of projections $P_1$ and $P_2$and hence, the space for unusual-shape hole 44 can be minimized in size and the construction thereof can be simplified as compared with the case where only one fulcrum for rocking is provided.

Figure 4:
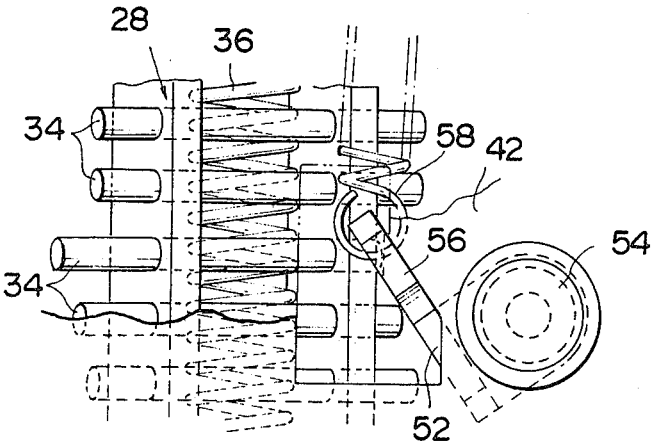
FIG. 4 is a plan view showing the state of clearing a plurality of tabs in the embodiment of the present invention.

In FIG. 3, explanation has been given to the case where only one tab pin which has been tab-set is cleared. FIG. 4 is a plan view showing the state where a plurality of tab pins are cleared. Namely, to clear a plurality of tab pins which have been tab-set, the carriage, not shown, is brought to a position corresponding to the tab pins 34 which have been tab-set or rightwardly of those tab pins 34, the tab set clear button 10 is pressed at the side of the minus mark in the abovedescribed condition, and the carriage is returned downwardly in FIG. 4 with the tab set clear button 10 being pressed at the side of the minus mark. As apparent from the foregoing, when the tab set clear button 10 is pressed at the side of the minus mark, the tab bracket 28 is inclined toward the tab clear wing 52. Consequently, in this condition, if the tab clear wing 52 is moved downwardly in FIG. 4, all of the tab pins 34 which have been projected into the carriage moving path are pressed by the tab clear wing 52 to be cleared wholely.

As has been described above, in the tab setting device of the typewriter according to the present invention, construction can be simplified and the space for unusual-shape hole for rocking the tab bracket can be minimized, thereby enabling to render the typewriter compact.

It should be apparent to one skilled in the art that the abovedescribed embodiments are merely illustrative of but a few of the many possible specific embodiments of the present invention. Numerous and varied other arrangements can be readily devised by those skilled in the art without departing from the spirit and scope of the invention.

What is claimed is:

1. A tab setting device of a typewriter, wherein a plurality of tab pins are oriented transversely to and slidably inserted into a tab bracket and a tab pin at each position where a carriage is to be stopped is projected into a carriage moving path to stop the carriage, characterized in that a hole shaped such that the tab bracket can rock in the hole is formed in a typewriter frame, said hole having a bottom surface, the tab bracket being supported by a pair of projections formed on said bottom surface, and one of said pair of the projections serving as a fulcrum for rocking of the tab bracket when a tab pin is projected, and the other of said pair of projections serving as a fulcrum for rocking of the tab bracket when a projected tab pin is retracted.

2. A tab setting device of a typewriter as set forth in claim 1, wherein opposing side surfaces of said hole are curved surfaces so that said tab bracket can rock.

3. A tab setting device of a typewriter as set forth in claim 1, wherein projected members are formed at opposing upper portions of a frame of typewriter, holding therebetween the hole for restricting the extent of rocking of the tab bracket.

* * * * *